US006095325A

United States Patent [19]

Simhaee

[11] Patent Number: 6,095,325

[45] Date of Patent: Aug. 1, 2000

[54] TUBULAR ABSORBENT PADS AND TRAY FOR FOOD PRODUCTS

[76] Inventor: Ebrahim Simhaee, 112 N. Maple Dr., Beverly Hills, Calif. 90210

[21] Appl. No.: 09/169,758

[22] Filed: Oct. 9, 1998

Related U.S. Application Data

[63] Continuation-in-part of application No. 09/070,174, Apr. 30, 1998.

[51] Int. Cl.[7] ..... B65D 81/26

[52] U.S. Cl. ..... 206/204; 206/205; 206/484; 206/564; 426/124

[58] Field of Search ..... 206/204, 564, 206/205, 820, 484; 426/106, 124, 129, 652, 326, 332; 428/74, 137, 138, 192; 239/56

[56] References Cited

U.S. PATENT DOCUMENTS

| | | | |
|---|---|---|---|
| 3,026,209 | 3/1962 | Niblack et al. | 206/204 |
| 3,739,913 | 6/1973 | Bogosian | 210/242 |
| 3,834,606 | 9/1974 | Andersson | 206/204 |
| 3,921,802 | 11/1975 | Thompson | 206/820 |
| 4,275,811 | 6/1981 | Miller . | |
| 4,321,997 | 3/1982 | Miller . | |
| 4,366,067 | 12/1982 | Golding et al. | 210/671 |
| 4,382,507 | 5/1983 | Miller . | |
| 4,756,939 | 7/1988 | Goodwin . | |
| 4,860,887 | 8/1989 | Fosse | 206/204 |
| 4,940,621 | 7/1990 | Rhodes et al. . | |
| 5,022,945 | 6/1991 | Rhodes et al. . | |
| 5,055,332 | 10/1991 | Rhodes et al. . | |
| 5,176,930 | 1/1993 | Kannakeril et al. . | |
| 5,181,802 | 1/1993 | Thengs et al. | 405/70 |
| 5,428,346 | 6/1995 | Franklin . | |
| 5,709,897 | 1/1998 | Pearlstein | 426/106 |

FOREIGN PATENT DOCUMENTS

| | | | |
|---|---|---|---|
| 004234632 | 4/1994 | France | 206/204 |

OTHER PUBLICATIONS

Copy of Nov. 1988 Brochure from Sealed Air Corporation (4 pages).

*Primary Examiner*—Paul T. Sewell
*Assistant Examiner*—Nhan T. Lam
*Attorney, Agent, or Firm*—Darby & Darby

[57] ABSTRACT

A tubular absorbent pad for food products and a method of manufacturing the pad are disclosed. The pad comprises at least one plastic sheet defining an outer layer of an axially elongated tube having a perforated moisture permeable portion. Absorbent material is disposed inwardly of the plastic sheet and defines at least one absorbent layer of the elongated tube, and super-absorbent material is disposed inwardly of the absorbent sheet, to form a tubular absorbent pad which can absorb liquid exuded from a food product. The invention further provides, in combination, a tray and one or more tubular absorbent pads, the tray being constructed and arranged for receiving the tubular absorbent pads. The tray comprises a body having a generally flat central section and four upstanding walls, the body defining at least one channel surrounding the central section which is shaped to receive tubular absorbent pads. The invention also provides a tray including a body having a generally flat central section and at least one channel disposed in the central section to receive the tubular absorbent pad. In another embodiment, the invention provides a tray comprising a body having a first layer spaced from a second layer. The first layer has a plurality of perforations to permit moisture from a food product supported on the first layer to migrate therethrough. The second layer includes a plurality of upstanding support knobs. At least one channel is defined along an edge of the body and shaped to receive the tubular absorbent pad.

6 Claims, 18 Drawing Sheets

TUBULAR ABSORBENT PADS AND TRAY FOR FOOD PRODUCTS

This application is a continuation-in-part of U.S. application Ser. No. 09/070,174, filed on Apr. 30, 1998.

BACKGROUND

1. Field of the Invention

The present invention relates generally to absorbent pads for absorbing fluid from packaged food products and, more particularly, to absorbent pads having a tubular cross section. The pads are adapted for use independently or with a tray having channels and a generally flat section disposed above the bottom of the channels. The tubular absorbent pads may be disposed in the channels of the tray.

2. Description of the Prior Art

It is common practice to store a food product such as meat, poultry and the like, in packages having a food supporting tray and an absorbent pad(s) of suitable material to absorb fluids exuded by the food product. There are presently two principal types of absorbent pads used in such packaging. In the first type, the pad is comprised of a plurality of absorbent layers or a mat of material, and an overlying plastic sheet. The plastic sheet is perforated to permit moisture to seep through to the absorbent layers. In the second type, a plurality of absorbent sheets are encapsulated between top and bottom plastic sheets, which are sealed along the edges thereof. The top plastic sheet is not perforated and therefore moisture impermeable. The bottom sheet is perforated to permit moisture to migrate through to the absorbent layers by capillary action. The configuration of the holes is arranged so as to allow moisture to flow only in a single direction. Accordingly, when water seeps into and is absorbed by the absorbent layers, the weight of the food placed on top of the pad which tends to normally squeeze the absorbent pad does not cause moisture to migrate from the absorbent material to the outside of the pad. Since the top plastic sheet is liquid impermeable, the food is prevented from making contact with the absorbent portion of the pad. To enhance moisture retention, synthetic super absorbent materials can be added between the layers of absorbent material.

Miller U.S. Pat. No. 4,410,578 discloses an absorbent pad for use in a receptacle to contain and display food products. The pad includes a mat of liquid absorbent material, an upper liquid impermeable plastic sheet overlying the absorbent mat, and a bottom plastic sheet underlying the absorbent mat. At least one of the sheets is perforated. A plurality of spacer elements are situated between the top and bottom sheets to maintain separation under a compressive load caused by the weight of the food. Any fluids exuded from the food flow around the pad and enter the mat by capillary action through the perforated openings in the bottom sheet.

Miller U.S. Pat. No. 4,321,997 discloses a receptacle for moisture exuding food products including a supporting tray and an absorbent pad disposed within the tray. The absorbent pad comprises a mat of liquid absorbent material, an upper liquid impermeable plastic sheet overlying the absorbent mat, and a bottom plastic sheet underlying the mat. At least one of the plastic sheets is perforated to permit the flow of liquid through the plastic and into the absorbent mat. A spacer structure is provided between the plastic sheets to maintain separation under the weight of the food product.

Miller U.S. Pat. Nos. 4,382,507 and 4,275,811 disclose an absorbent pad for use in a tray containing food products. The absorbent pad includes a mat of paper wadding a layer of wood fluff. A plastic liquid impermeable sheet overlies one side of the mat, and a plastic perforated sheet overlies the opposite side of the mat.

Rhodes et al. U.S. Pat. Nos. 4,940,621, 5,055,332 and 5,022,945 disclose an absorbent pad for food products including an upper and lower plastic film, at least one of which is perforated, and an intermediate absorbent layer sandwiched between the plastic layers. The intermediate absorbent layer includes a series of juxtaposed and overlapping absorbent material fibers with super-absorbent granules dispersed throughout the absorbent layer and supported by the absorbent material fibers in the spaces between the fibers. The upper and lower film layers are attached to each other along opposite marginal edges thereof to retain the absorbent layer therebetween.

Goodwin U.S. Pat. No. 4,756,939 discloses an absorbent pad including a mat of fluid absorbent material having oppositely facing flat surfaces and a cover fabricated from a liquid impermeable material enclosing the mat. The cover has two oppositely facing substantially flat imperforate surfaces corresponding to the oppositely facing surfaces of the mat, and side portions corresponding to the sides of the mat. At least two of the side portions of the cover have a plurality of perforations to permit passage of the fluid from the food through the cover and into the mat.

Kannankeril et al. U.S. Pat. No. 5,176,930 discloses a food package and absorbent pad in which the rate of absorbency is ostensibly increased by providing an intermediate layer of absorbent material which extends to the periphery of the pad to wick liquids into the pad.

Each of these absorbent pad arrangements have certain disadvantages. Specifically, they have a generally flat profile which requires a relatively large amount of polyethylene for the plastic layer(s). In addition, because the food is placed on the top of the pad, the pressure imposed on the pad by the weight of the food decreases the capability of the pad to absorb moisture, and can cause the absorbed fluids to flow back out into the package causing rapid bacterial growth, food spoilage, and discoloration.

SUMMARY OF THE INVENTION

In view of the foregoing, it is an object of the present invention to provide an improved absorbent pad for use in food packaging.

It is another object of the present invention to provide an absorbent pad for use in food packaging which requires less plastic (such as, for example, polyethylene) for the pad components, which is more environmentally friendly, and can be fabricated at lower costs compared to conventional flat pads.

It is another object of the present invention to provide an absorbent pad for use in food packaging which resists compression and squeeze out of absorbed fluids under the weight of the food product in the packaging.

It is yet another object of the present invention to provide an absorbent pad for use in food packaging which can be economically and rapidly manufactured.

It is still another object of the present invention to provide an absorbent pad for use in food packaging which uses less material compared to conventional flat absorbent pads.

It is another object of the present invention to provide an improved food packaging system including an absorbent pad and a food tray, wherein the food product does not rest directly on the pad.

In accordance with the above objects and additional objects that will become apparent hereinafter, the present invention provides a tubular absorbent pad for food products, comprising at least one water permeable plastic sheet (e.g., perforated polyethylene) defining an outer layer of an axially elongated tube, the plastic sheet having a moisture permeable portion, and an absorbent material disposed radially inwardly of the plastic sheet.

The present invention also provides a method of fabricating tubular absorbent pads for food products, comprising the steps of:

(a) providing a plastic sheet of material having a perforated moisture permeable portion;

(b) placing absorbent material over the plastic sheet;

(c) forming the plastic sheet and absorbent material into a tube;

(d) sealing the tube at locations spaced axially along the tube to define a plurality of sealed tubular pads; and (e) separating the individual tubes.

Another aspect of the invention provides a system for absorbing moisture from stored food products. The system comprises a tray and one or more tubular absorbent pads. The tray is constructed and arranged for receiving the tubular absorbent pads, and comprises a four-sided body having a generally flat central section and four upstanding walls. The body defines a channel which is shaped to receive the tubular absorbent pad(s). Food supported on the central section of the tray does not compress the absorbent pad(s). In other embodiments, a plurality of channels are formed in the central section of the tray. These channels receive complimentary shaped absorbent pads.

The invention further provides, in combination, a tray and one or more tubular absorbent pads, where the tray includes an elongated plastic sheet which is folded back on itself along the edges thereof to define one or more channels for the absorbent pads. The plastic sheet defines a central flat section on which the food product is placed. A plurality of perforations are formed in the flat section to allow moisture to flow unidirectionally from the food product to the bottom of the flat section. The channel(s) have a plurality of perforations which permit moisture to flow unidirectionally from the bottom of the flat section into the absorbent pads.

The invention further provides, in combination, a tray and one or more tubular absorbent pads. The tray comprises a first member and a second member which are spaced apart to define a fluid passageway therebetween. The first member and the second member are joined along upstanding side walls and further define at least one channel communicating with the fluid passageway for receiving a tubular absorbent pad. The first member is perforated to permit moisture exuded from a food product supported on the first member to flow into the fluid passageway. The second member includes a plurality of upstanding protrusions for supporting the first member and maintaining the space between the first member and the second member.

BRIEF DESCRIPTION OF THE DRAWINGS

In accordance with the above, the present invention will now be described in detail with particular reference to the accompanying drawings.

DETAILED DESCRIPTION OF THE PREFERRED EMBODIMENTS

Referring to the several views of the drawings, there is shown a tubular absorbent pad and tray for use in food packaging to absorb and retain fluids exuded from the food product.

Figure 7A:
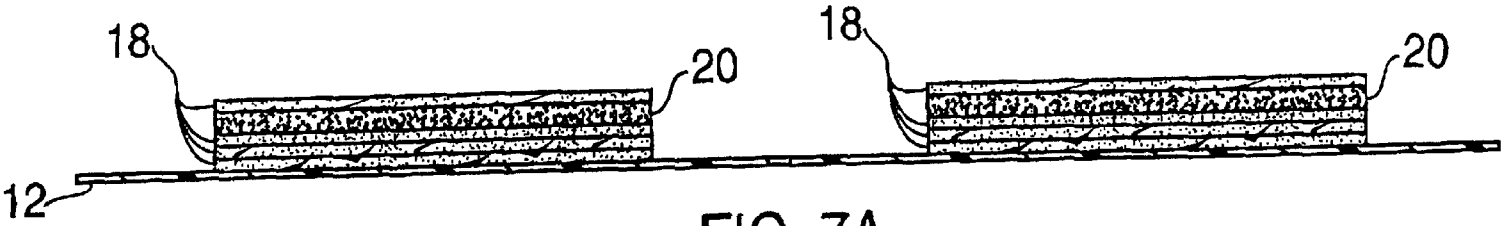
FIG. 7A is a sectional view along lines 7*a*—7*a* in FIG. 6.
Figure 7B:
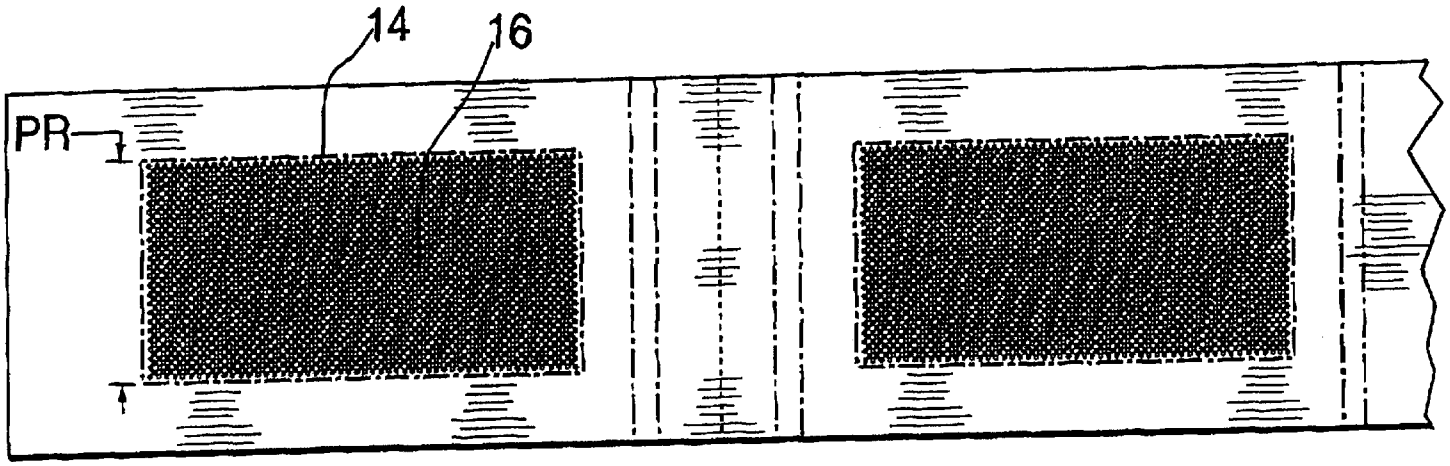
FIG. 7B is a bottom plan view of the perforated plastic sheet.

The pad is indicated generally at 10 and includes at least one plastic sheet or film 12 defining an outer layer of an axially elongated tube. The plastic sheet 12 is a material which is non-reactive to food products. For example, a flexible thermoplastic, such as polyethylene having a thickness in the range of from about 0.00035 to 0.0005 inches may be employed. The plastic sheet 12 is provided with a moisture permeable portion 14 having a multiplicity of perforations 16 (FIG. 7B). The plastic sheet 12 serves as a hydrophobic barrier to prevent the reverse flow of moisture out of the pad 10 and against the food product. In a preferred embodiment, the perforations 16 are disposed in a perforated region "PR" (FIGS. 5B and 5C) defined by an arc segment of an outer circumference of the tube, where the arc segment is less than or equal to approximately 180°. In this manner, only the imperforate portion of the plastic sheet makes contact with the food. The perforations are about one-eighth to one-fourth inch apart, and can be formed in a perforating operation, such as, for example, by contacting the sheet 12 with a roll covered with pins of a nominal diameter. This type of perforating operation is used on textile carding cloth. In this manner, the perforations 16 are punched through the plastic 12 in a manner which tapers in one direction as is well known in the art. Thus, liquid absorbed by the pad 10 is prevented from migrating in a reverse direction back out of the 10.

At least one sheet 18 of absorbent material is disposed in a generally concentric orientation inwardly of the plastic sheet 12. In the preferred embodiment, a plurality of absorbent layers 18 are rolled with the plastic sheet 12 into an elongated tube 11. The absorbent material may consist of a wood fluff of the type known in the art. Wood fluff is comprised of de-fibrized cellulose fibers which have been formed into a compressed batt in the manner of a non-woven fabric. A layer of thin tissue wadding may be added to the wood fluff during manufacturing. The wadding has a texture similar to facial tissue. The layers of wadding and wood fluff are interconnected using methods known in the art. Alternatively, the absorbent layer may be constructed from non-woven cellulose and thermoplastic fibers which are juxtaposed and overlapped or superimposed relative to one another and compressed sufficiently to maintain integrity during manufacturing. Other absorbent materials include synthetic pulp such as rayon, cotton or combinations thereof. During fabrication of the pads 10, the absorbent sheets 18 are placed flat over the plastic sheet 12 and concentrically rolled into the elongated tube 11 as described in more detail below.

A strip 20 of super-absorbent material is preferably disposed inwardly of the absorbent sheets 18, such that the plastic sheet 12, absorbent sheets 18 and super-absorbent strip 20 form a laminated tubular absorbent pad 10. The super-absorbent material may consist of granules selected from chemical compounds that have liquid super-absorption capability, including, but not limited to, carboxylmethylcellulose super-absorbent compound and an acrylic super-absorbent compound such as acrylic acid and sodium acrylate copolymer. The super-absorbent material retains moisture exuded from the food product and prevents such fluid from migrating out of the pad. Alternatively, super-absorbent granules may be dispersed between absorbent layers of the laminated structure.

Figure 4:
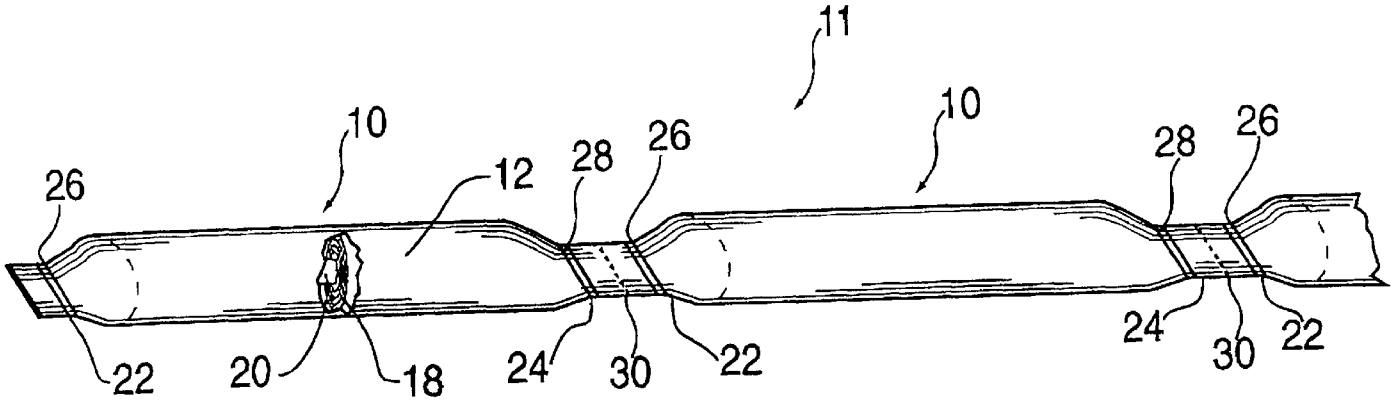
FIG. 4 is an isometric view of a formed tube assembly containing a plurality of sealed tubular pads.
Figure 6:
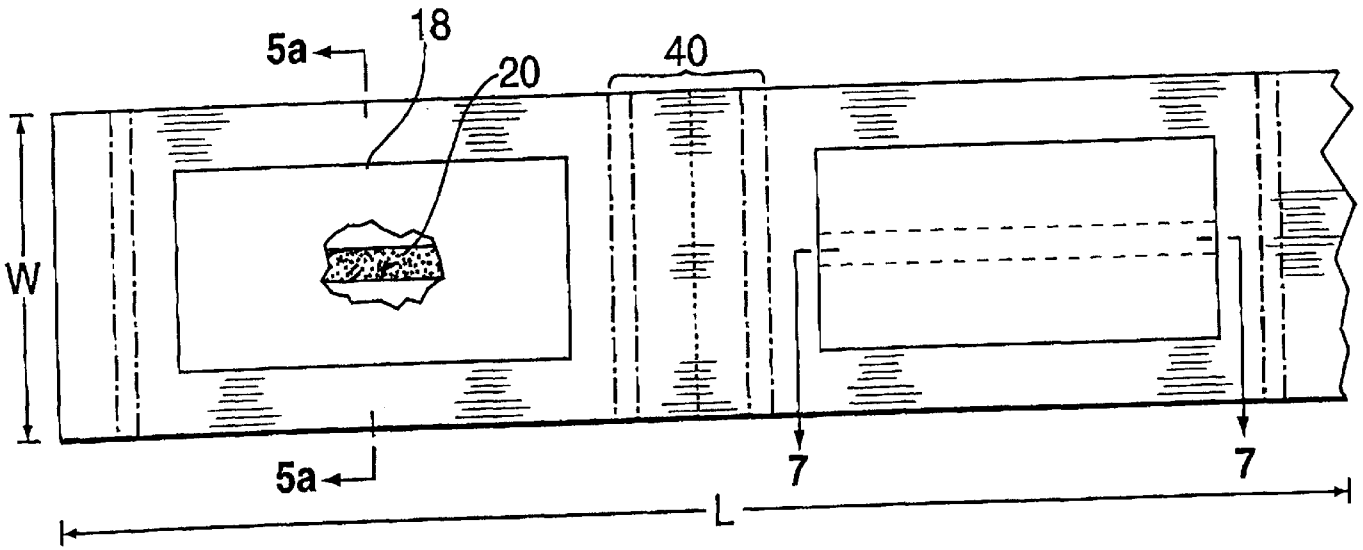
FIG. 6 is a top plan view of the stack of pad components prior to forming the elongated tube.
Figure 5A:
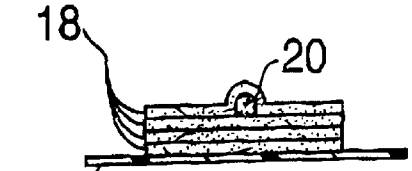
FIG. 5A is a sectional view of a stack of the pad components prior to forming the elongated tube.
Figure 5C:
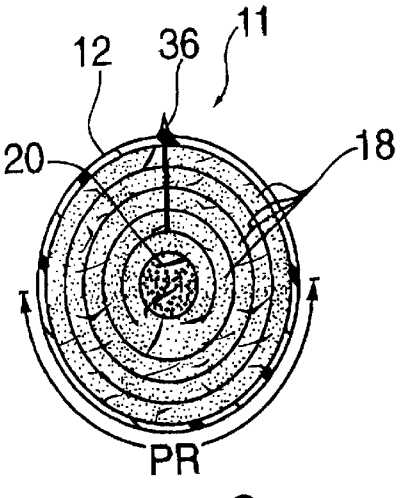
FIG. 5C is a sectional view identical to FIG. 5B with the top seam sealed and trimmed.
Figure 5B:
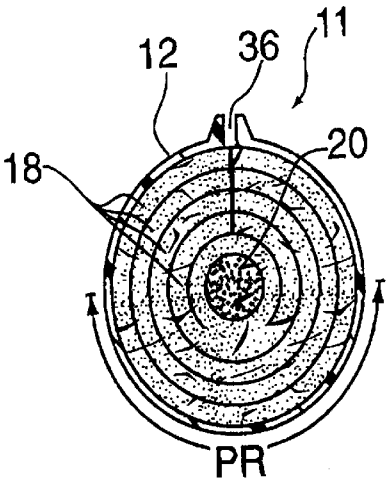
FIG. 5B is a sectional view through a formed elongated tube prior to heat sealing the longitudinal seam.
Figure 5F:
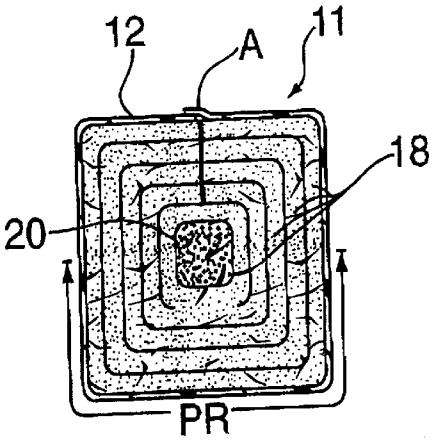
FIG. 5F is a sectional view of an alternative tube cross-section.
Figure 5E:
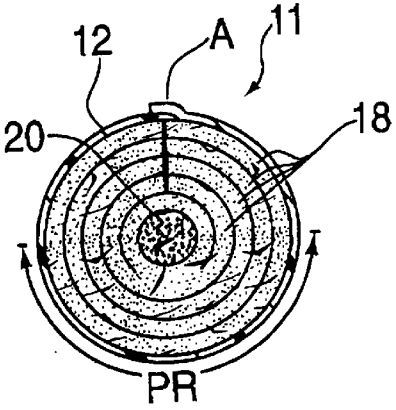
FIG. 5E is a sectional view of an alternative tube cross-section.
Figure 5D:
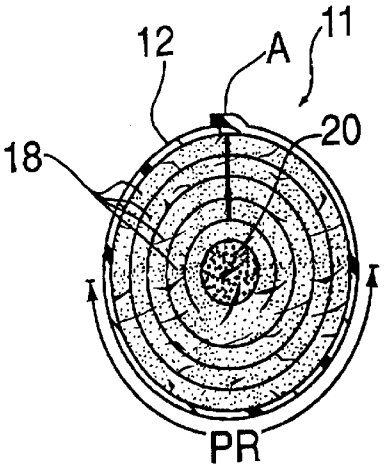
FIG. 5D is a sectional view of an alternative tube embodiment having an overlapping joint.

The pads 10 in accordance with the present invention are fabricated as a continuous tube 11 as shown in FIG. 4. Each individual pad 10 in the tube 11 has a first end 22, and a second end 24 which are sealed at locations 26, 28, respectively, by heat sealing or the like. A separation line 30 is provided between adjacent sealed locations 26, 28 to facilitate separation of individual tubes 10 from the tube 11. In this connection, the present invention provides a method for manufacturing a series of pads 10 as an axially elongated tube 11. First, as shown in FIGS. 5A, 6, 7A, 7B and 11, at least one plastic sheet 12 having a length L and width W is placed on a flat supporting surface generally indicated at 32 (see FIG. 11). The plastic sheet 12 can be extruded using an extrusion machine shown schematically at 34, or manufactured as a film using conventional techniques. The plastic sheet 12 contains perforations 16 in a central region 14 corresponding to an arc segment of 180° or less when rolled into a tubular structure. The perforations 16 may be put into the plastic sheet 12 before the absorbent material 18 is disposed on the sheet 12. The perforated region PR is shown in FIGS. 5B and 5C. A plurality of sheets 18 of absorbent material are placed in overlying relationship on the plastic sheet 12. The absorbent sheets 18 may be stacked with each subsequent sheet having the same length L, but slightly smaller width W than the preceding sheet. The absorbent sheets 18 are fabricated in accordance with known methods using materials described above. An elongated strip 20 of super-absorbent material is placed over the next to last absorbent sheet 18 as shown. A top absorbent sheet 18 is placed over the super-absorbent strip 20. This laminate is then advanced to a rolling station indicated generally at 38 and a tubular assembly 11 is formed by rolling the respective sheets into an axially elongated tubular structure. Although shown in the drawings as generally cylindrical, the tubular assembly 11 may be formed into other cross-sectional shapes, including oval (FIG. 5E), four sided (FIG. 5F), etc. The plastic sheet 12 is slit sealed along a flanged portion of excess material 36 defined at one side of the tubular pad. Alternatively, the plastic sheet 12 can be rolled with a bonded overlapping region "A" (FIG. 5D). A safe, edible water-resistant glue may be used. The glue is applied along one edge of the plastic sheet 12. In the slit sealed embodiment, the slit sealed step is performed using a slit seal machine of the type known in the art. Concurrently, or at a later step, the tubular structure is heat sealed at the respective first and second locations 26, 28 of each pad 10 to define respective first and second ends 22, 24 spaced axially along the tube 11. A line of perforations 30 is then formed using conventional methods intermediate adjacent heat seals 26, 28 in the region 40 between adjacent pads 10 to facilitate separation.

Figure 9:
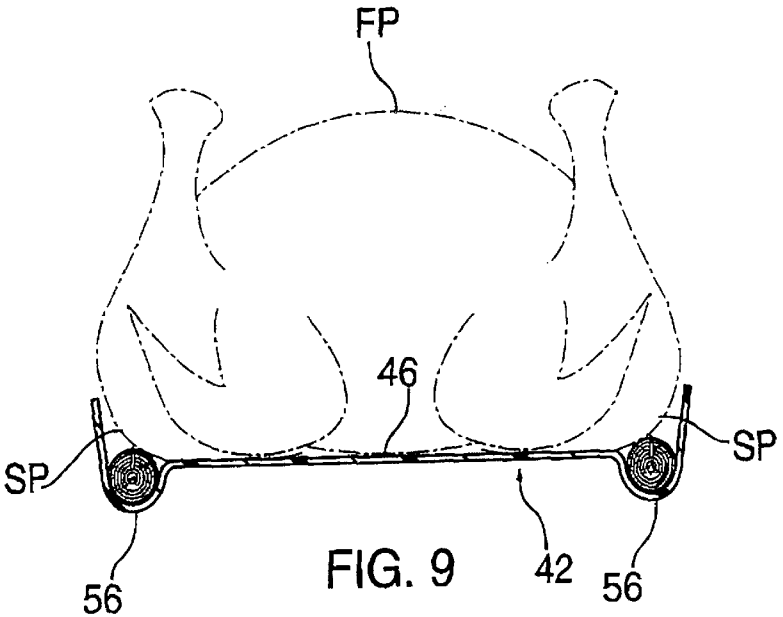
FIG. 9 is a sectional view of a tray and pad assembly in accordance with the present invention.
Figure 10B:
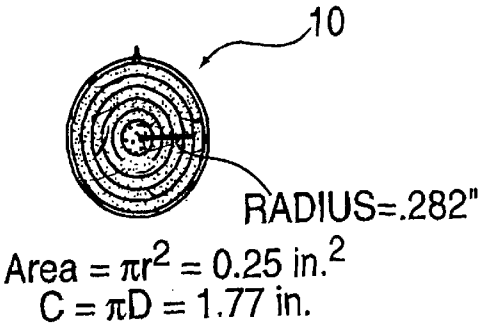
FIG. 10B is a sectional view of a pad in accordance with the present invention as shown in FIG. 9.
Figure 8:
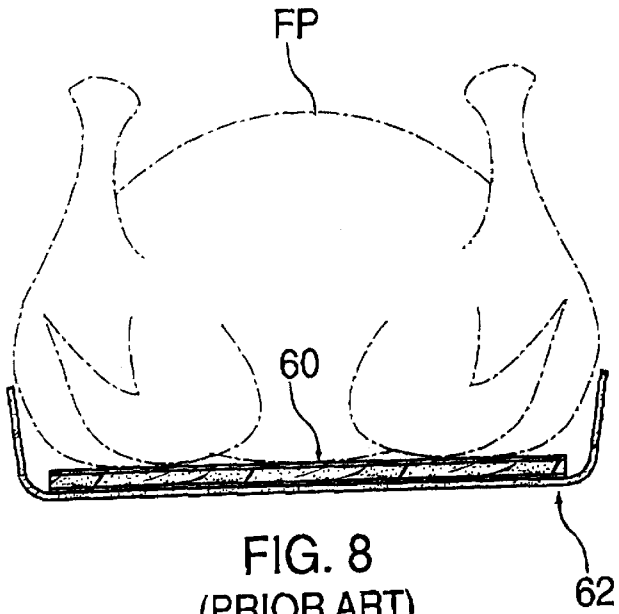
FIG. 8 (PRIOR ART)
FIG. 8 is a sectional view of a prior art pad and tray assembly.
Figure 10A:
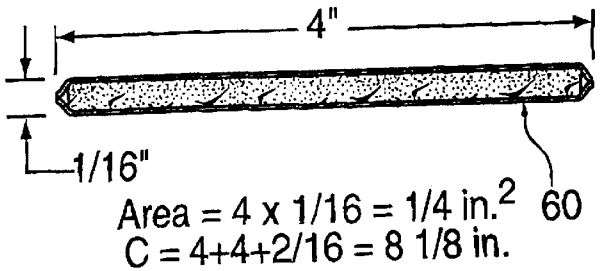
FIG. 10A (PRIOR ART)
FIG. 10A is a sectional view of the prior art pad shown in FIG. 8.
Figure 11:
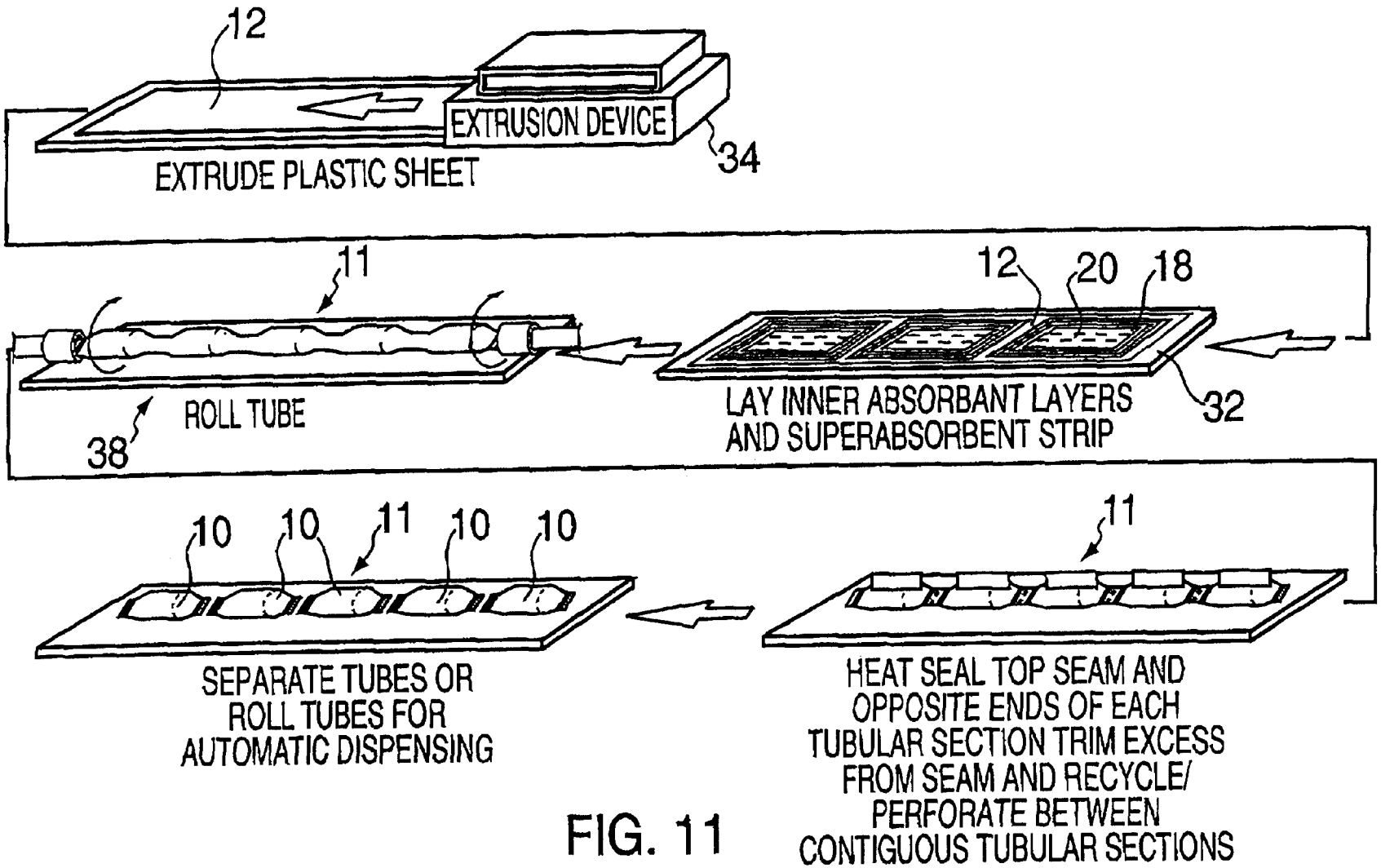
FIG. 11 is a flow diagram of a simplified illustrative manufacturing process for the tubular pads of the present invention.

The resulting tubular pad requires less plastic material to provide the same cross sectional area as prior art flat pads. For example, FIGS. 8, 10A and 9, 10B respectively depict cross sections of a prior art flat pad 60 and a tubular pad 10 in accordance with the present invention. The flat pad 60 is placed in a conventional tray 62 having a flat bottom with no channels. The tubular pad shown in FIG. 9 resides in a tray 42 having a channel(s) in accordance with the present invention as described in more detail below. For the purpose of comparison, a typical flat pad 60 having a width of 4 inches and a height of 1/16, has a cross sectional area of 0.25 sq. inches. In contrast, a tubular pad having a radius R=0.282 inches has an equal cross sectional area of 0.25 sq. inches in accordance with the formula $A=\pi R^2$. The circumference of the circle C having this radius R is 1.77 inches in accordance with the formula $C=2\pi R$. Thus, a smaller plastic sheet is required to fabricate the pad of the present invention. The width of the plastic sheet for the pad 10 is about 77.87% less than that of the prior art flat pad 60 with two layers of polyethylene, and 55.75% less than a pad 60 with one layer of polyethylene, a substantial savings in the plastic material required to construct a pad with an equal cross sectional area, and accordingly, an equal volume. In other words, the same moisture retention capacity can be provided by a pad using less polyethylene if shaped in accordance with the present invention.

Referring now to FIGS. 1, 2, 3 and 9, in the preferred embodiment of the present invention, the tray 42 comprises a four-sided body 44 having a generally flat central section 46 and four upstanding walls 48, 50, 52, and 54. The body 44 defines a single channel which surrounds the central section 46. The tray 42 is sized such that the body 44 has a nominal thickness of about one-sixteenth to one-eighth inch. This channel 56 has a bottom or outer surface which supports the tray 42, and is shaped to receive the tubular absorbent pads 10 described above. In this connection, the channel 56 is sized and arranged such that only a small or no portion of the tubular pads 10 protrudes above the central section 46. Since the tubular pads reside in the channel 56, there is less pressure exerted on the bottom portion of the pads due to the weight of the food product FP. Thus, there is less likelihood of squeezing out moisture absorbed and retained by the pads 10. Furthermore, moisture which flows from the food product FP into the channels is prevented from making further contact with the food product FP because the channel geometry acts as a sump. The pads 10 may be arranged within the channel 56 such that a pad 10 is disposed along one or more of the walls 48, 50, 52 and 54. The food product FP is placed on the center section 46 of the tray as shown. The side portions SP of the food may rest on the tubular pads 10, and moisture exuded from the food travels into the channel 56 and through the perforations 16 in the plastic sheets 12 of the pads 10. In an alternative embodiment (not shown), the channel need not completely surround the central portion of the tray. For example, a pair of opposed channels may extend along the lengthwise direction of the tray but not the transverse direction. Alternatively, a pair of opposed channels may extend along the transverse walls but not the lengthwise walls. In either embodiment, the areas without the channel are defined by the central portion merging into the respective sidewall.

Referring now to FIGS. 1A, 1B, 1C and 1D, in an alternative embodiment of the present invention, the tray 42*a* comprises a body 44*a* having a generally flat section 46*a*. The body 44*a* defines a plurality of channels 56*a* disposed within the generally flat section 46*a*. The channels 56*a* have an inner surface shaped to receive the tubular absorbent pad 10 described above. In this connection, the channels 56*a* are sized and arranged such that only a small or no portion of the tubular absorbent pad 10 protrudes above the generally flat section 46*a*. As in the preferred embodiment above, since the tubular absorbent pad 10 resides in the channels 56*a*, there is less pressure exerted on the bottom portion of the tubular absorbent pad 10 due to the weight of the food product FP. Furthermore, the channels 56*a* are arranged such that the support surface formed by the flat section 46*a* evenly distributes the weight of the food product FP. Thus, there is less likelihood of squeezing out moisture absorbed and retained by the tubular absorbent pad 10. Furthermore, moisture which flows from the food product FP into the channels 56*a* is prevented from making further contact with the food product FP because the channel geometry acts as a sump. The food product FP is placed on the generally flat section 46*a* of the tray 42*a* once the tubular absorbent pad 10 has been placed in the channels 56*a*. Moisture exuded from the food product FP travels into the channels 56*a* and through the perforations 16 in the plastic sheets 12 of the tubular absorbent pads 10.

Figure 1:
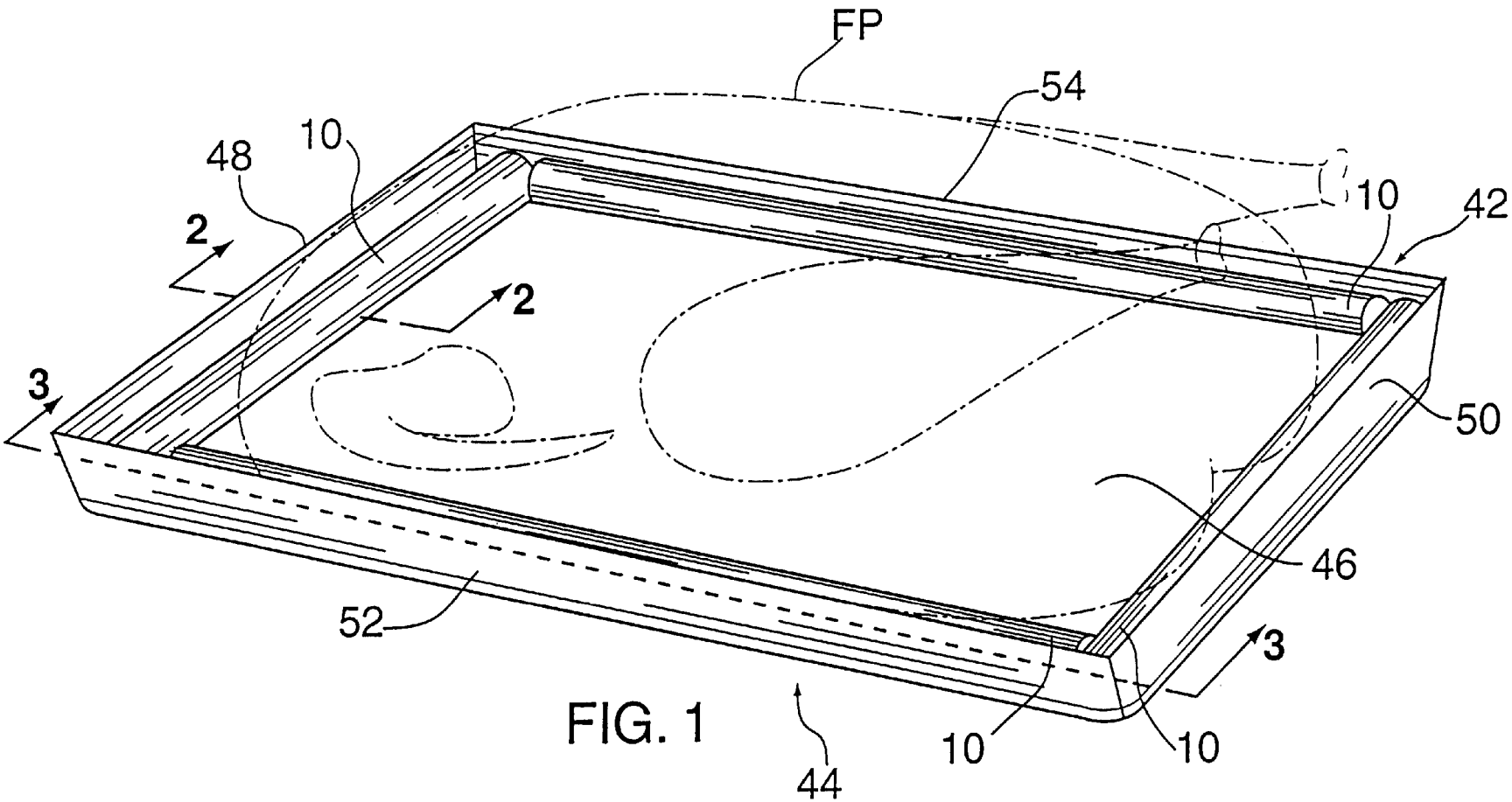
FIG. 1 is an isometric view of a tray and tubular absorbent pads disposed therein in accordance with the present invention.
Figure 1A:
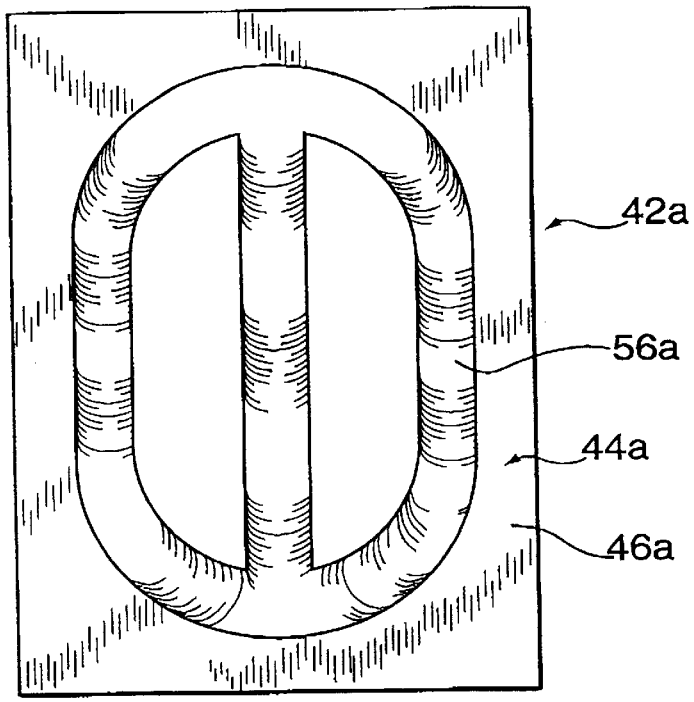
FIG. 1A is a top plan view of a tray in accordance with another embodiment of the present invention.
Figure 1B:
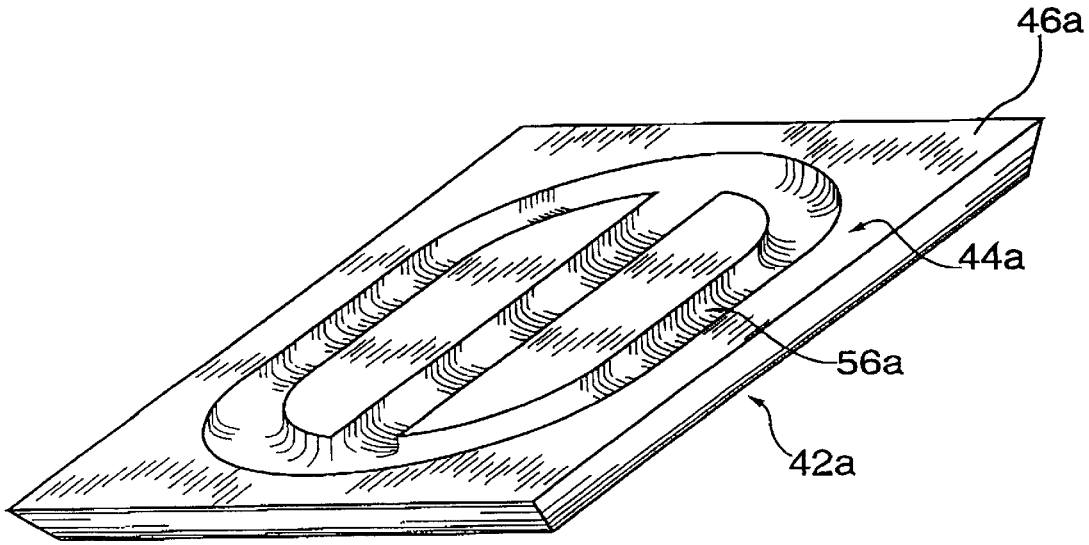
FIG. 1B is an isometric view of the tray of FIG. 1A.
Figure 1C:
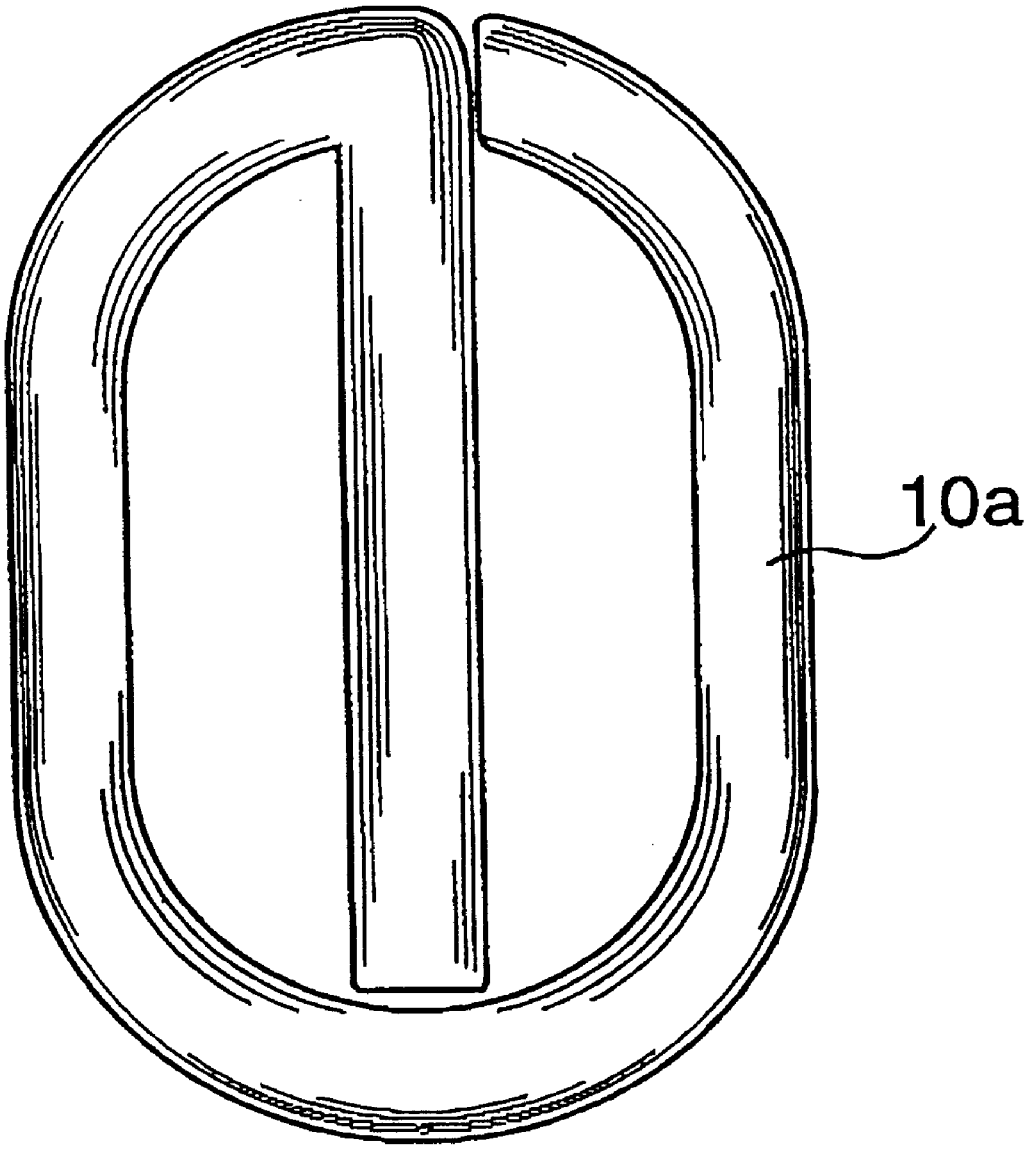
FIG. 1C is a top plan view of a tubular absorbent pad for use with the tray of FIG. 1A in accordance with another embodiment of the present invention.
Figure 1D:
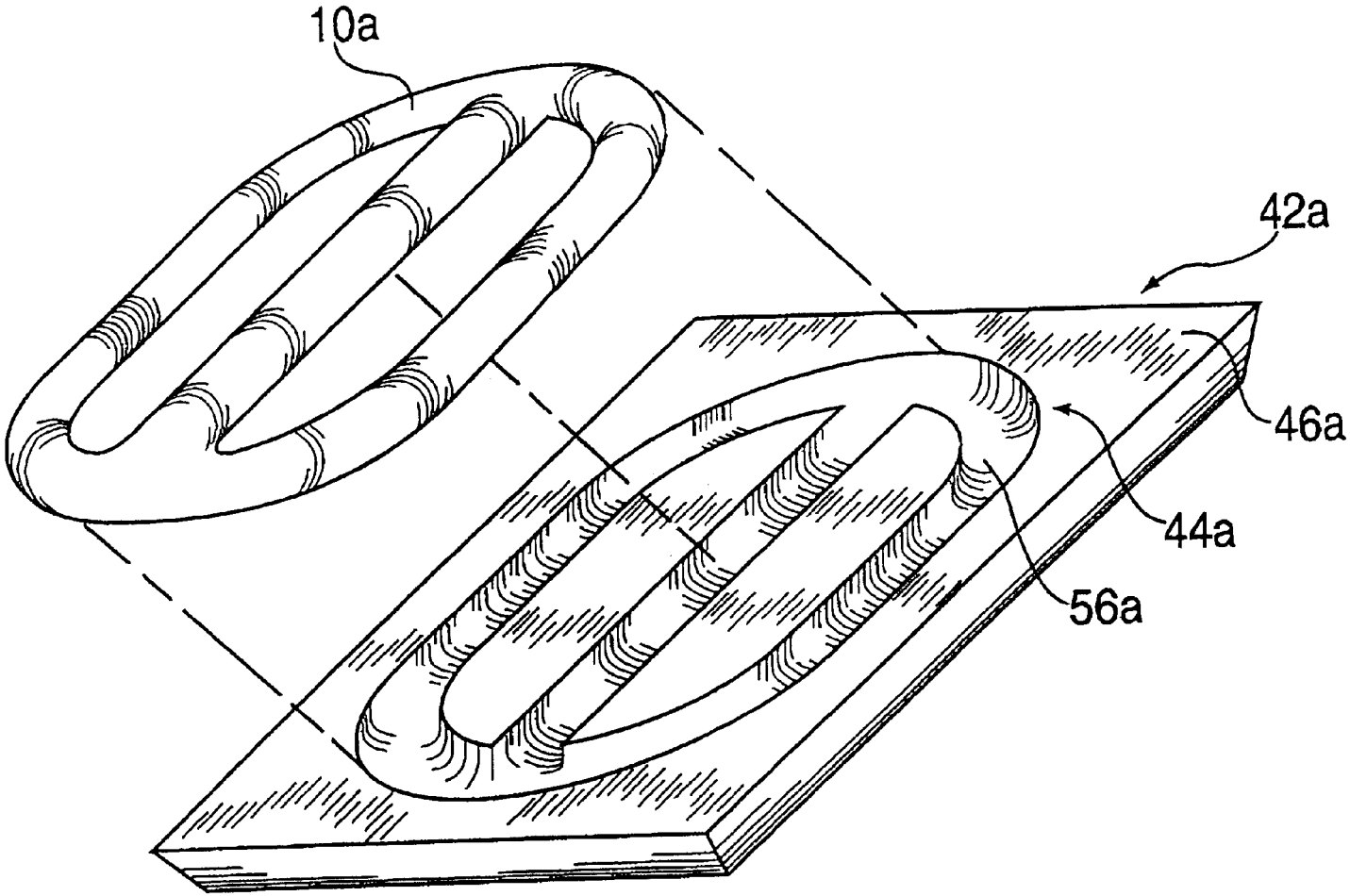
FIG. 1D is an isometric view of the tray of FIG. 1A and the tubular absorbent pad of FIG. 1C, illustrating how the tubular absorbent pad is placed in the tray.
Figure 2:
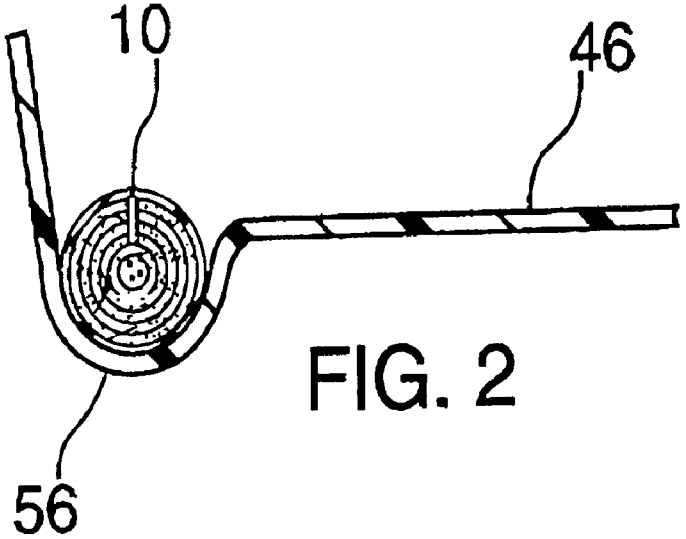
FIG. 2 is a sectional view along lines 2—2 in FIG. 1.
Figure 3:
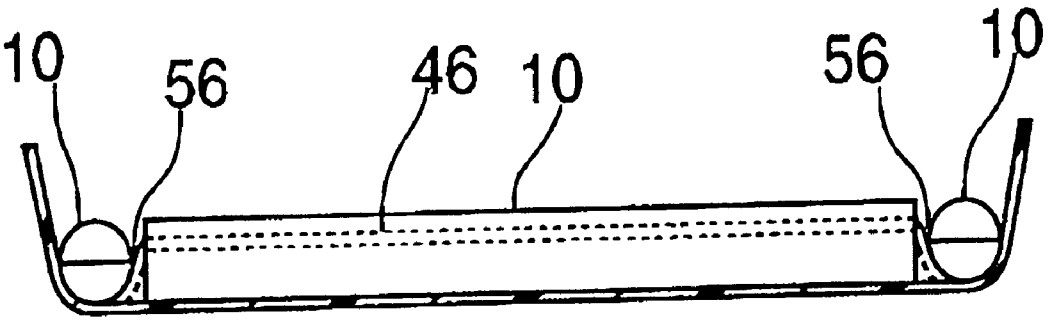
FIG. 3 is a sectional view along lines 3—3 in FIG. 1.
Figure 2A:
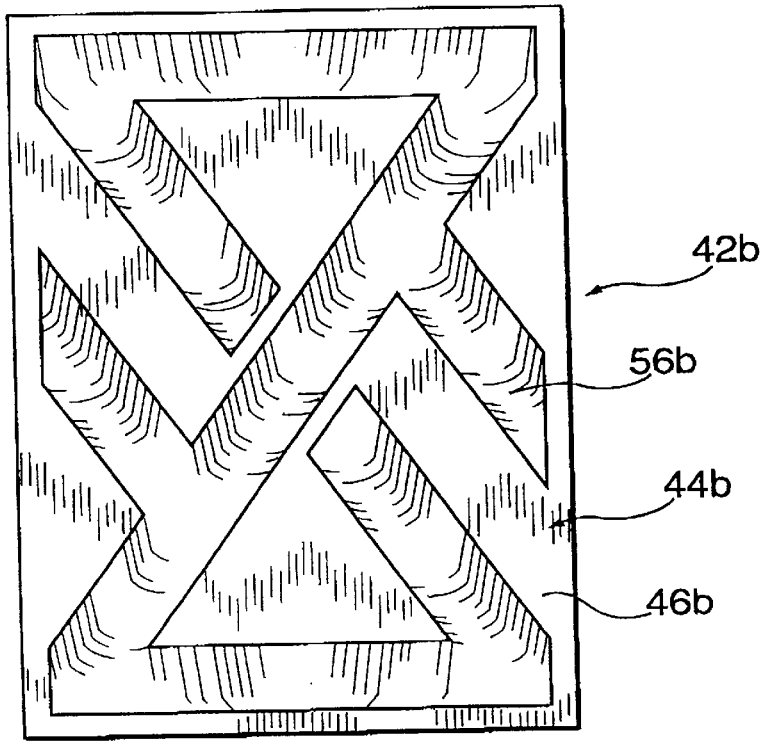
FIG. 2A is a top plan view of a tray in accordance with another embodiment of the present invention.
Figure 2B:
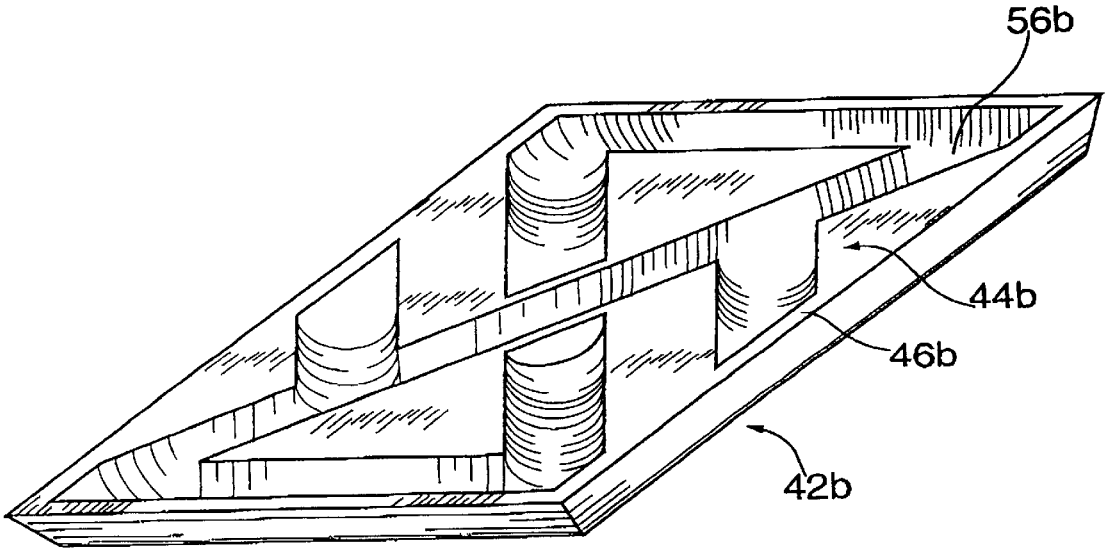
FIG. 2B is an isometric view of the tray of FIG. 2A.
Figure 2C:
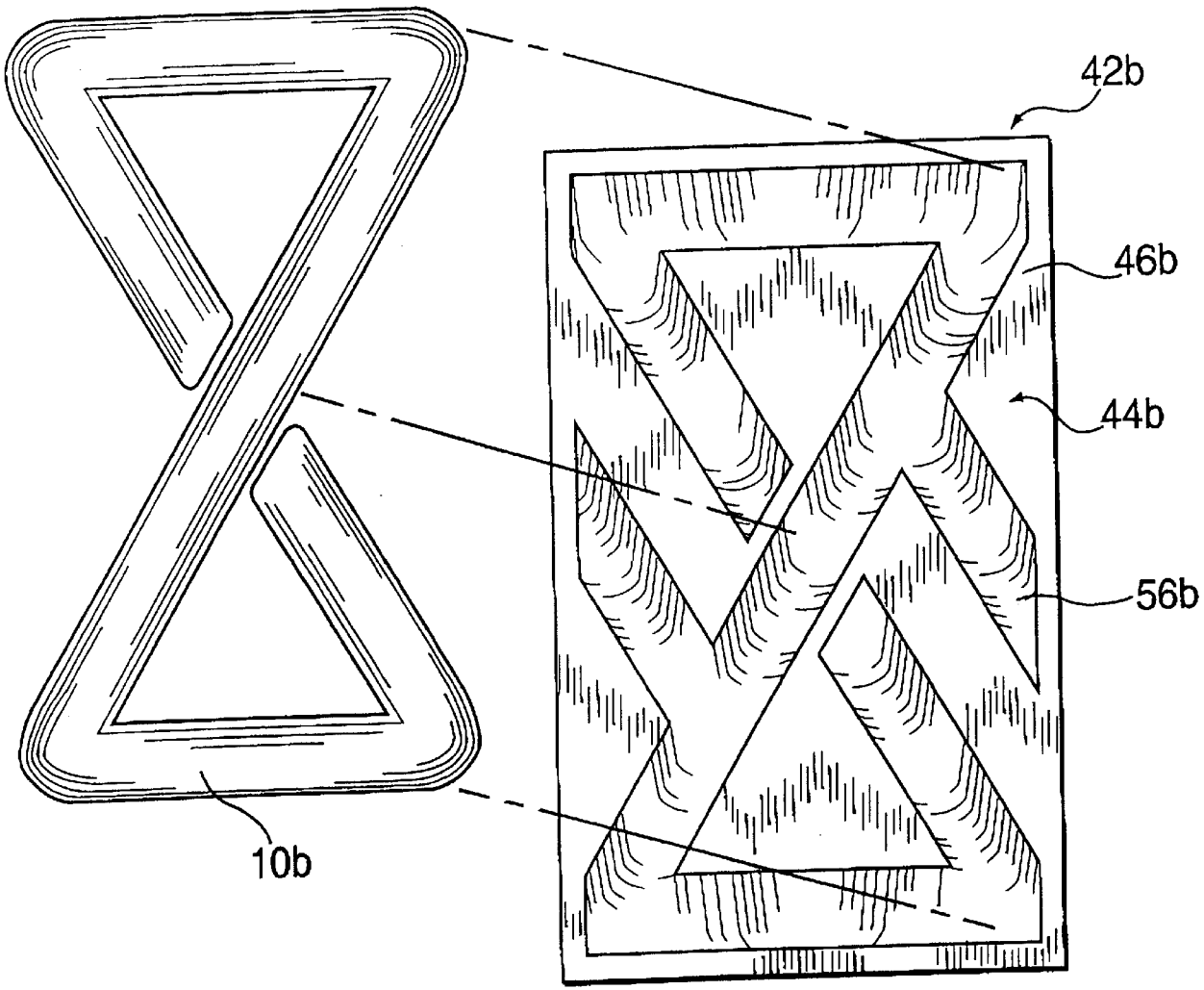
FIG. 2C is a top plan view of the tray of FIG. 2A and a tubular absorbent pad, illustrating how the tubular absorbent pad is placed in the tray.

Referring now to FIGS. 2A, 2B and 2C, in another alternative embodiment of the present invention, the tray 42*b* comprises a body 44*b* having a generally flat section 46*b*. The body 44*b* defines a plurality of channels 56*b* disposed within the generally flat section 46*b*. The channels 56*b* have an inner surface shaped to receive the tubular absorbent pad 10 described above.

Figure 3A:
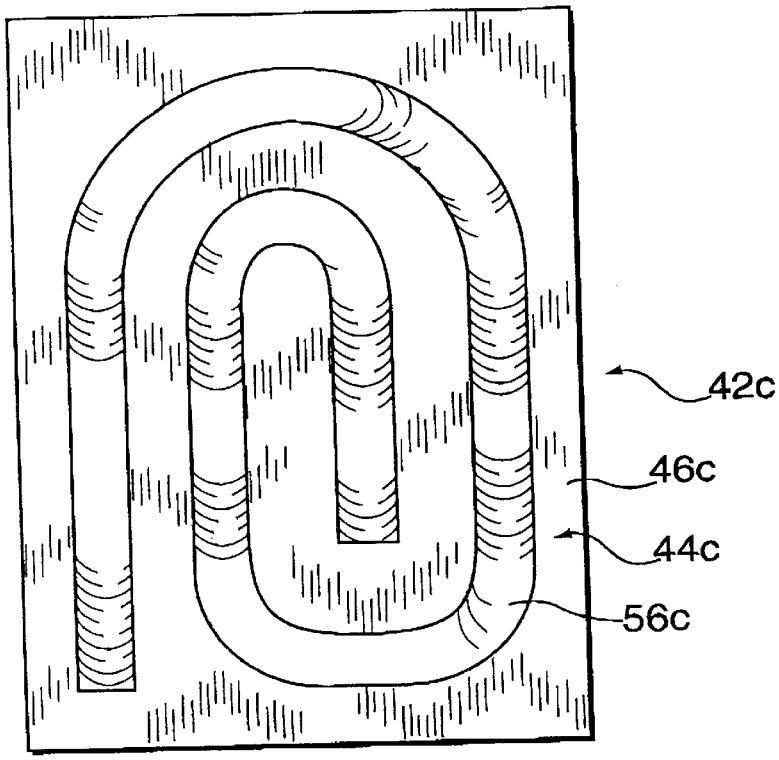
FIG. 3A is a top plan view of a tray in accordance with another embodiment of the present invention.
Figure 3B:
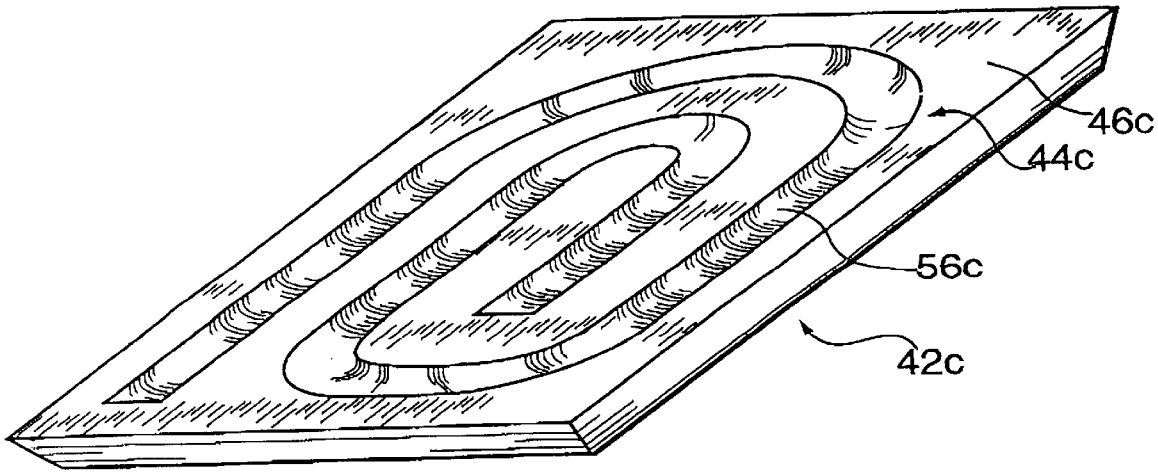
FIG. 3B is an isometric view of the tray of FIG. 3A.
Figure 3C:
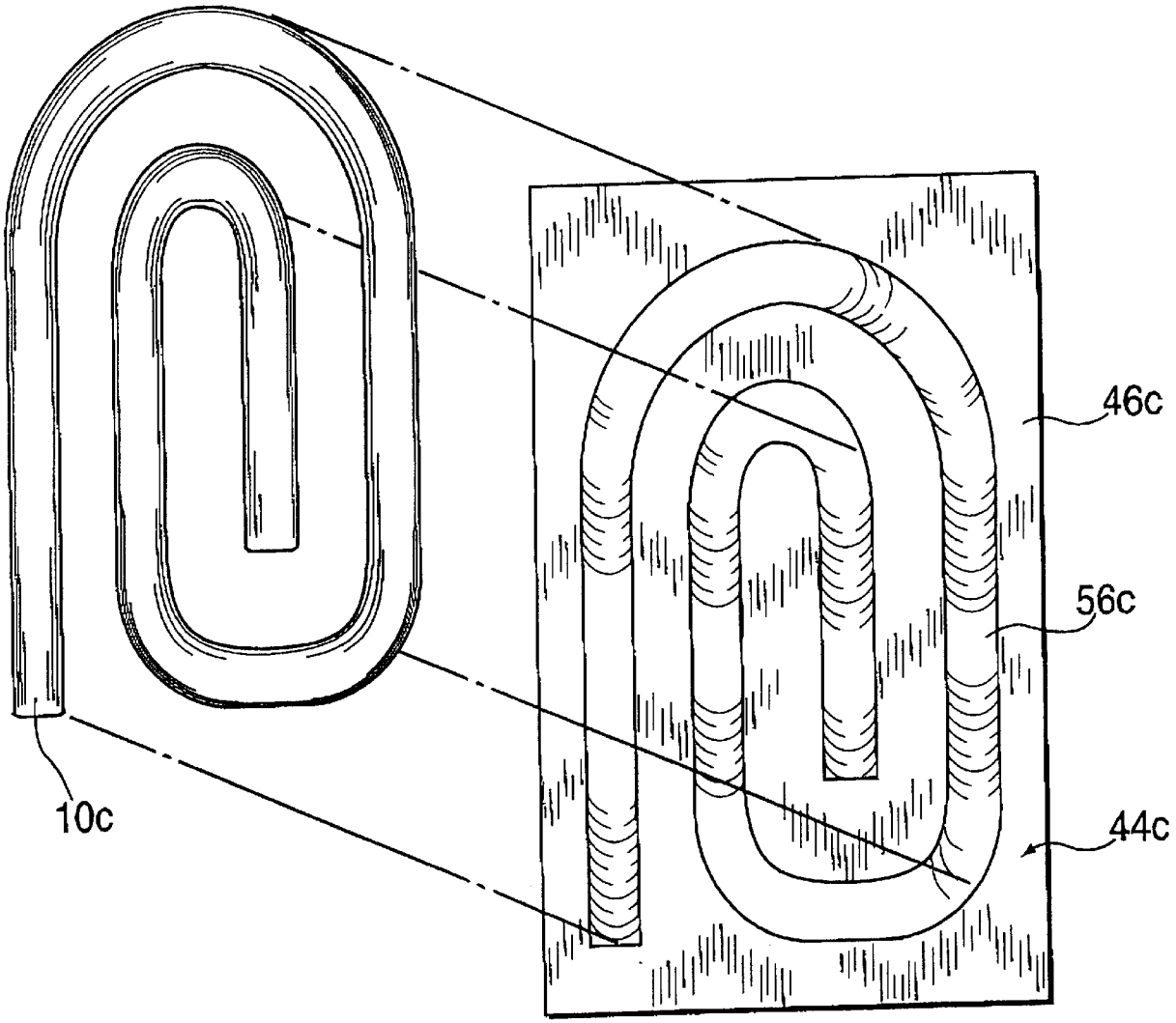
FIG. 3C is a top plan view of the tray of FIG. 3A and a tubular absorbent pad, illustrating how the tubular absorbent pad is placed in the tray.

Referring now to FIGS. 3A, 3B and 3C, in yet another alternative embodiment of the present invention, the tray 42*c* comprises a body 44*c* having a generally flat section 46*c*. The body 44*c* defines a single channel 56*c* disposed within the generally flat section 46*c*. The channel 56*c* wraps inwardly from the outer edge of the tray 42*c* towards the center of the tray 42*c* as shown. This channel geometry is another example of the many channel shapes that may be utilized within the scope of the invention.

Figure 12A:
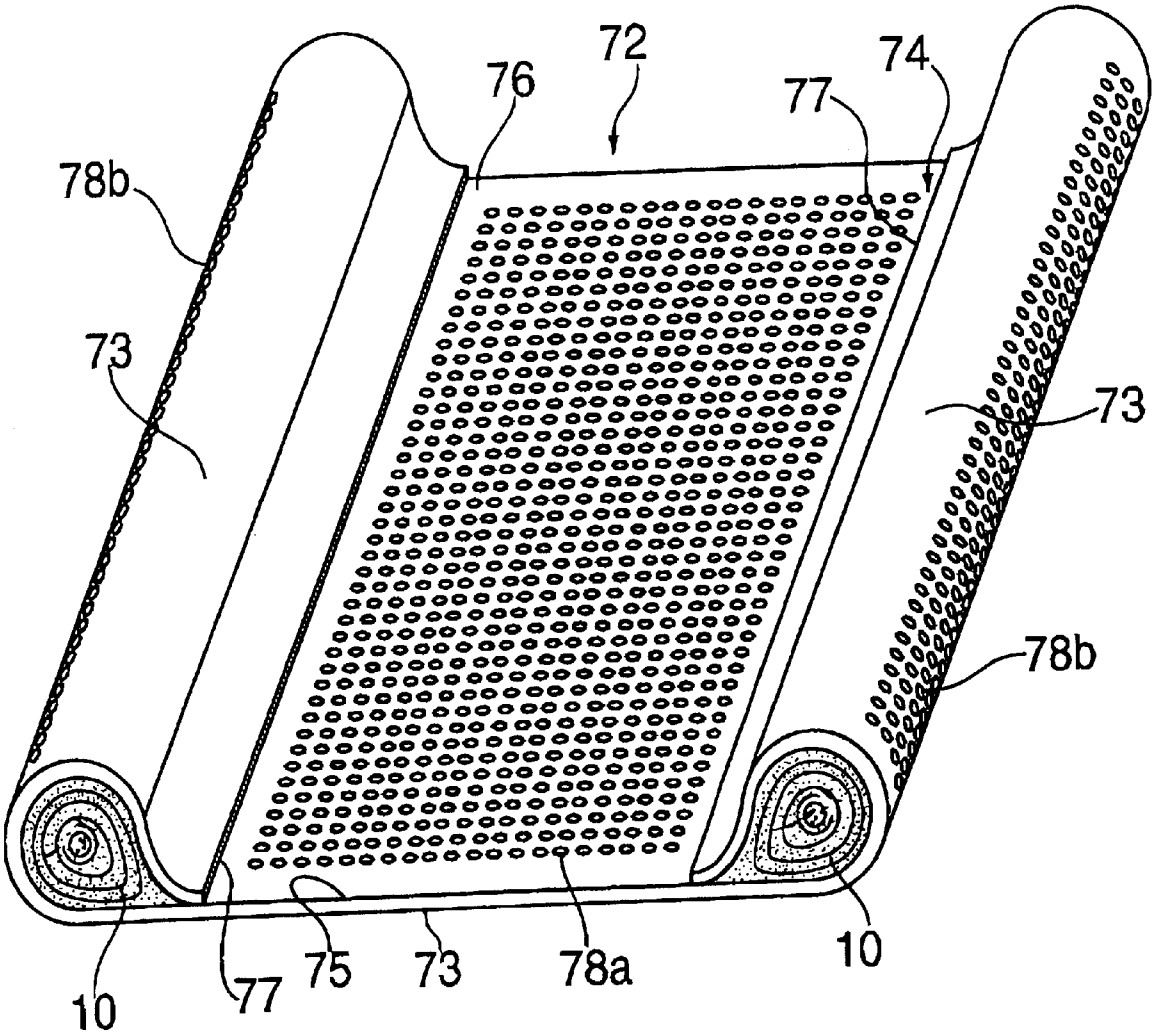
FIG. 12A is an isometric view of a tray and tubular absorbent pads disposed therein in accordance with another embodiment of the present invention.
Figure 12B:
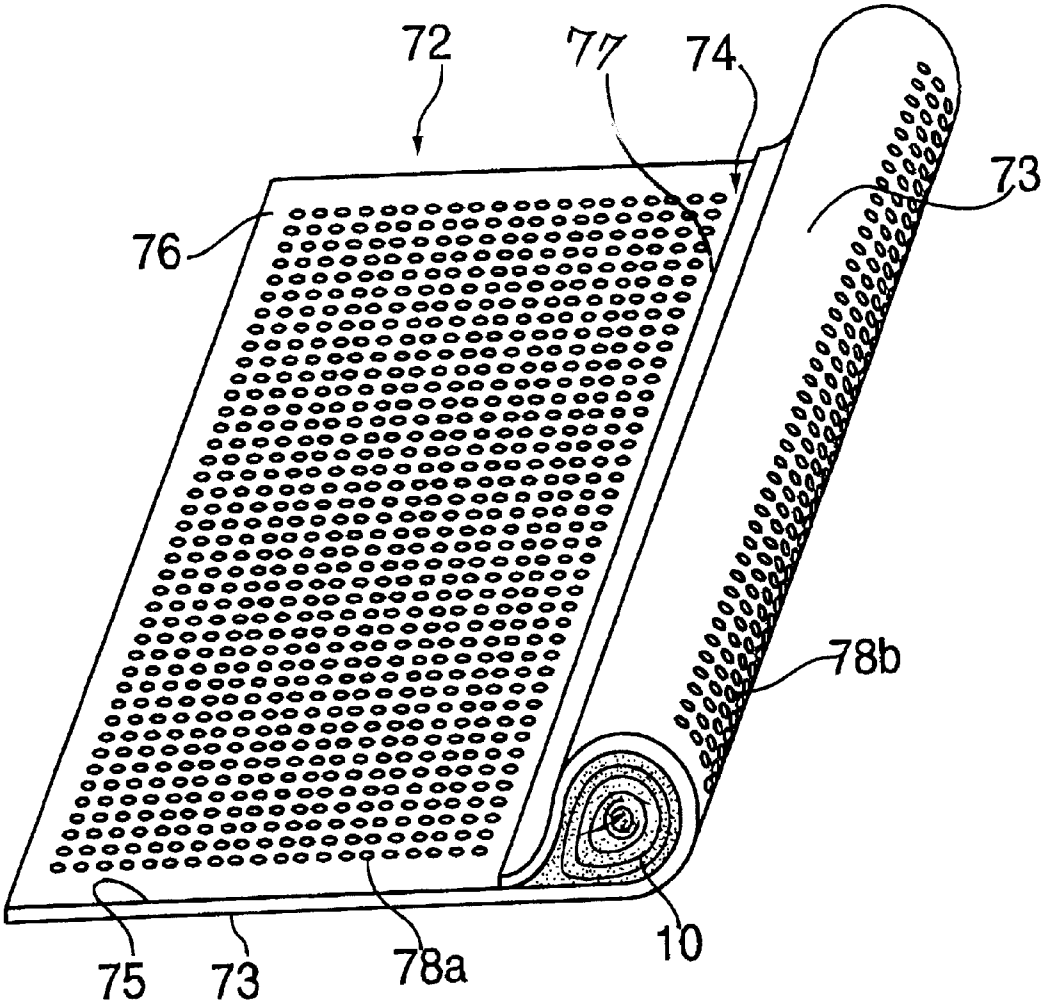
FIG. 12B is an isometric view of a tray and tubular absorbent pad disposed therein in accordance with another embodiment of the present invention.
Figure 13:
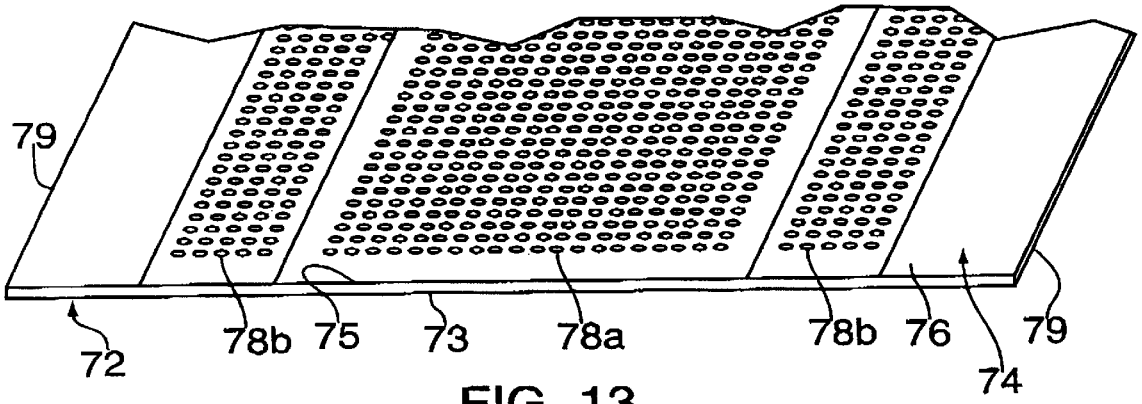
FIG. 13 is an isometric view of an illustrative first stage work piece in the assembly of the tray and tubular absorbent pads of FIG. 12A.
Figure 14:
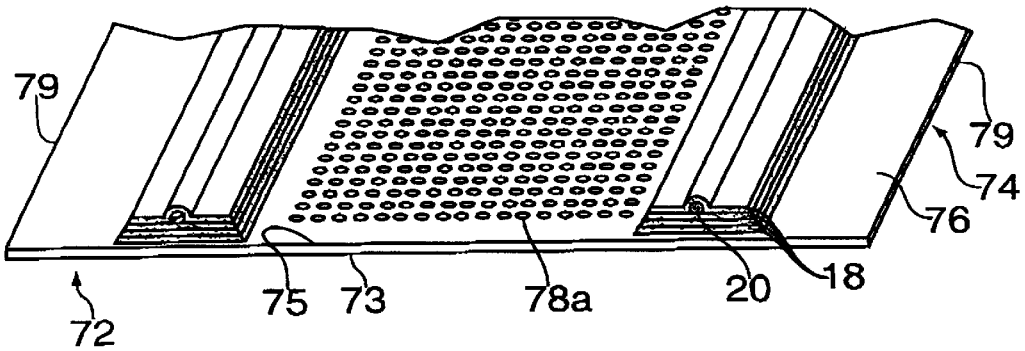
FIG. 14 is an isometric view of an illustrative second stage work piece in the assembly of the tray and tubular absorbent pads of FIG. 12A.

Referring now to FIGS. 12A and 12B, an alternative embodiment of the present invention is depicted in which the tray 72 comprises an elongated plastic sheet 74 having a generally flat section 76. The food product is placed on the flat section 76. The extended plastic sheet 74 is folded back on itself and sealed at 77 which causes absorbent pads 10 to be formed as described below along outer edges of the generally flat section 76. The extended plastic sheet 74 comprises an upper surface 75 and a lower surface 73. A plurality of perforations 78*a* and 78*b* are formed in the extended plastic sheet 74 to facilitate communication of moisture through the plastic sheet 74. Perforations 78*a* permit the flow of moisture from the food product to the underside of the central section 76. In this regard, perforations 78*a* are formed as described in the first embodiment to permit unidirectional flow between surface 75 and surface 73. Perforations 78*b* allow moisture to flow from surface 73 to surface 75 and thereby into the pad 10. In other words, perforations 78*b* facilitate the flow of moisture through the plastic sheet 74 in the opposite direction to the flow through perforations 78*a*. The border between the perforations 78*a* and 78*b* is depicted in FIGS. 13 and 14. Moisture from the food product flows through the perforations 78*a* to the bottom of the flat section 76 and wicks along surface 73 to the perforations 78*b*. From there, the moisture passes into the pad(s) 10. Capillary action increases the speed at which the moisture migrates into the tubular absorbent pad(s) 10.

Figure 15:
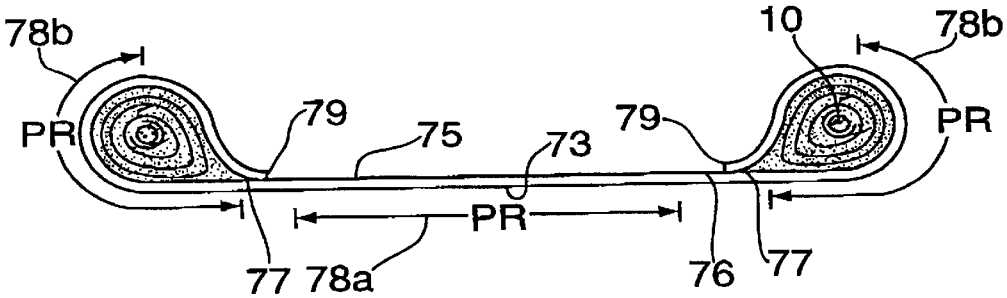
FIG. 15 is a side elevation view of an illustrative final stage work piece in the assembly of the tray and tubular absorbent pads of FIG. 12A.

With further reference to FIGS. 13, 14 and 15, a method of making the embodiment of FIG. 12A is described. The extended plastic sheet 74 having an upper surface 75 and a lower surface 73 is placed on a flat surface and a plurality of sheets 18 of absorbent material are placed in overlying relationship on the plastic sheet 74. The absorbent sheets 18 may be stacked with each subsequent sheet having the same length L, but slightly smaller width W than the preceding sheet. The absorbent sheets 18 are fabricated in accordance with known methods using materials described above. An elongated strip 20 of super-absorbent material is placed over the next to last absorbent sheet 18 as shown. A top absorbent sheet 18 is placed over the super-absorbent strip 20. The edges 79 of the plastic sheet 74 are rolled inwardly and sealed against the upper surface 75 as depicted in FIG. 15 to form the pads 10 from the absorbent sheets 18 and the super-absorbent strips 20.

Figure 16:
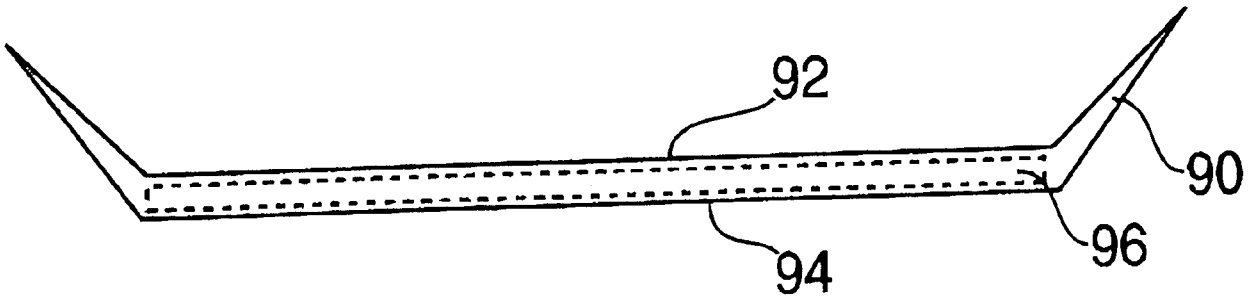
FIG. 16 (Prior Art)
FIG. 16 is a side elevation view of a prior art pad and double-walled tray assembly.

Referring to FIG. 16, there is depicted a prior art double-walled tray assembly with an absorbent pad 96 located between a perforated top tray 92 and a bottom tray 94. One of the problems associated with this type of tray, is that the weight of the food product on the perforated top tray 92 sometimes forces the absorbed water to flow upward and back to the perforated top tray 92, causing the water to contact the food product.

Figure 17:
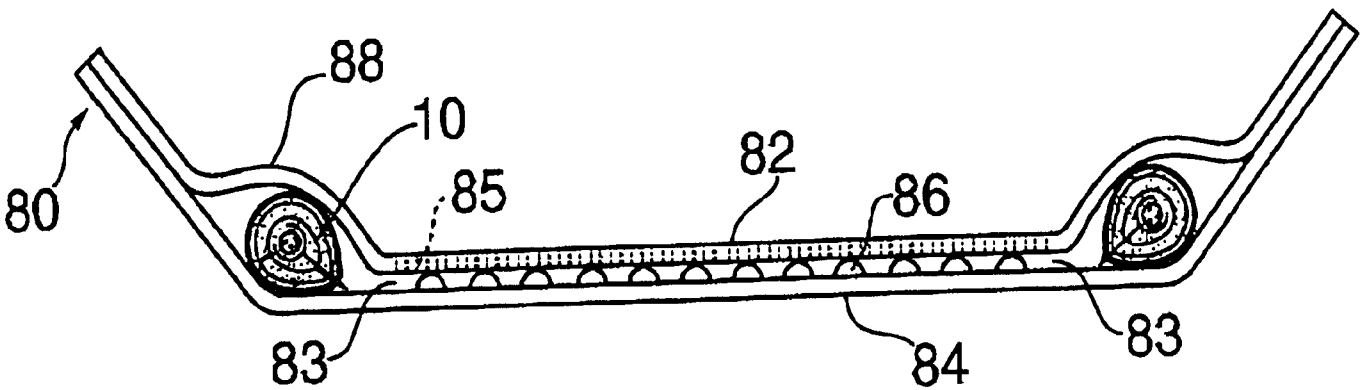
FIG. 17 is a side elevation view of a double-walled tray and tubular absorbent pads disposed therein in accordance with another embodiment of the present invention.

In a further embodiment of the present invention shown in FIG. 17, the tray comprises a perforated upper member 82 and a lower member 84. The upper member 82 and lower member 84 are welded along side walls designated at 80 and spaced apart to define a space to provide a fluid passageway 83. The upper member includes a plurality of perforations 85 in the central area on which the food product is supported. The lower member 84 has a plurality of hemispherical knobs 86 for maintaining the fluid passageway 83 between the upper member 82 and the lower member 84. In the illustrative embodiment, the radius of the hemisphere for each of the hemispherical knobs 86 is approximately 1/32" to 1/16" and they are disposed about 1/4" to 1/2" apart from each other. The hemispherical knobs may alternatively be constructed on the bottom of the upper member 82. It will be understood to one skilled in the art that other support structures may be employed to maintain a space between the upper member 82 and the lower member 84 when the food product is supported on the upper member 82. The upper member 82 and lower member 84 are shaped so as to define channels 88. The channel 88 has an inner surface shaped to receive the tubular absorbent pad 10 described above. Since the tubular absorbent pad 10 is surrounded by the channel 88, there is less likelihood of squeezing out moisture absorbed and retained by the tubular absorbent pad 10. Furthermore, moisture which flows from the food product through the perforations in the upper member 82 and into the fluid passageway 83 between the upper member 82 and the lower member 84, is prevented from making further contact with the food product. Capillary action increases the speed at which the moisture migrates between the upper member 82 and the lower member 84, and into the channel(s) 88 in which the tubular absorbent pad(s) 10 is located.

The tubular absorbent pads 10 in accordance with the invention may be used with or without the tray 82. If the tubular absorbent pads 10 are used with a conventional tray 62 (FIG. 8), the side portions SP of the food product are supported on the side of the pads 10 which is liquid impermeable. However, the pads 10 provide superior moisture retention compared to standard flat pads because the majority of the weight of the food product is supported by the flat central portion of the tray, not the pads. In addition, the exuded moisture can flow more directly into the perforated region PR. The moisture enters the perforations 16 by capillary action and is wicked into the absorbent sheets 18. The super-absorbent strip 20 acts to further retain the absorbed moisture. The perforations 16 act as check valves by essentially making the flow path unidirectional. In this manner, substantially all of the exuded fluid is absorbed and retained by the pads 10 to minimize food spoilage and discoloration. The upper portion or liquid impervious region of the pads 10 remains relatively dry and unspoiled. If the pads 10 are used in conjunction with the tray 42 of the present invention, it is possible to remove the weight of the food from the pad, preventing pad compression and facilitating the flow of exuded fluids into a sump. This arrangement acts to further prevent exuded fluid from coming into contact with the food product FP.

The present invention has been shown and described in what are considered to be the most practical and preferred embodiments. It is anticipated, however, that departures can be made therefrom and that obvious modifications will be implemented by persons skilled in the art.

I claim:

1. For use in absorbing moisture from stored food products, the combination comprising a tray and at least one tubular absorbent pad, said tray being constructed and arranged for receiving said tubular absorbent pad, the tray comprising:

a body having a generally elevated flat central section and four upstanding walls, said body defining at least one channel extending around an edge of said central section, said at least one channel being shaped to receive said tubular absorbent pad, wherein said at least one tubular absorbent pad comprises at least one plastic sheet defining an outer layer of an axially elongated tube, said plastic sheet having a perforated moisture permeable portion; and an absorbent material disposed inwardly of said plastic sheet.

2. The combination recited in claim 1, further including a super-absorbent material disposed within said axially elongated tube.

3. For use in absorbing moisture from stored food products, the combination comprising a tray and at least one tubular absorbent pad, said tray being constructed and arranged for receiving said tubular absorbent pad, the tray comprising:

a body having a generally flat central section and defining at least one channel disposed in said central section, said at least one channel being shaped to receive said tubular absorbent pad, wherein said at least one tubular absorbent pad comprises at least one plastic sheet defining an outer layer of an axially elongated tube, said plastic sheet having a perforated moisture permeable portion; and an absorbent material disposed inwardly of said plastic sheet.

4. The combination recited in claim 3, further including a super-absorbent material disposed within said axially elongated tube.

5. For use in absorbing moisture from stored food products, the combination comprising a tray and at least one tubular absorbent pad, said tray being constructed and arranged for receiving said tubular absorbent pad, the tray comprising:

a body having a first member and a second member, said first member being spaced from said second member to define a fluid passageway therebetween, said first member having a plurality of perforations to permit moisture from a food product supported on the first member to migrate therethrough, said body further including at least one channel extending along an edge of said body and being shaped to receive said tubular absorbent pad, said channel communicating with a space formed between said first member and said second member to permit moisture collected in said space to be absorbed by said tubular absorbent pad, wherein said at least one tubular absorbent pad comprises at least one plastic sheet defining an outer layer of an axially elongated tube, said plastic sheet having a perforated moisture permeable portion; and an absorbent material disposed inwardly of said plastic sheet.

6. The combination recited in claim 5, further including a super-absorbent material disposed within said axially elongated tube.

* * * * *